US005312261A

United States Patent [19]

Burke et al.

[11] Patent Number: 5,312,261

[45] Date of Patent: May 17, 1994

[54] PROGRAMMABLE INPUT-OUTPUT ELECTRICAL CONNECTOR

[75] Inventors: Rodger W. Burke, Lisle; Jerry A. Long, Elgin; Paul A. Reisdorf, LaGrange; Stephen A. Sampson, Downers Grove, all of Ill.

[73] Assignee: Molex Incorporated, Lisle, Ill.

[21] Appl. No.: 17,582

[22] Filed: Feb. 16, 1993

[51] Int. Cl.[5] ..... H01R 29/00

[52] U.S. Cl. ..... 439/52; 439/925

[58] Field of Search ..... 439/52, 53, 189, 516, 439/925

[56] References Cited

U.S. PATENT DOCUMENTS 4,508,399 4/1985 Dowling et al. ..... 439/925

5,037,308 8/1991 Bryce et al. ..... 439/52

5,181,852 1/1993 Dambach et al. ..... 439/52

*Primary Examiner*—Neil Abrams

*Attorney, Agent, or Firm*—A. A. Tirva

[57] ABSTRACT

A programmable input-output electrical connector is provided for electrically coupling a plurality of conductors with an electronic component having a plurality of circuits. The connector includes a dielectric housing. A programming multi-contact bus is mounted in the housing. The bus includes a plurality of spring contacts normally biased into engagement with respective circuits on the electronic component. The spring contacts are individually selectively movable to inoperative positions out of engagement with the circuits. Latch devices are operatively associated with the spring contacts for positively holding each spring contact individually in its inoperative position.

3 Claims, 3 Drawing Sheets

PROGRAMMABLE INPUT-OUTPUT ELECTRICAL CONNECTOR

FIELD OF THE INVENTION

This invention generally relates to the art of electrical connectors and, particularly, to an input-output electrical connector for electrically coupling a plurality of conductors with an electronic component or device.

BACKGROUND OF THE INVENTION

There are many applications in the electronic industry, such as in copying machines, computers and the like, wherein a plurality of conductors must be terminated to various electronic components to carry out various functions of a machine or apparatus. For instance, in a copying machine, control electronics are fed through data conductors or lines and power conductors or lines to various devices, such as motors, audible or visual indicators, or the like which perform the various functions of the machine, such as changing the reduction of the copying process, varying the numbers of copies, rendering audible or visual signals, and the like. Electronic components or devices, such as printed circuit boards, integrated circuit chips, headers or connectors must be coupled through electrical connectors to the power and data transmission conductors or lines.

Some such electronic systems of the character described above include a programming means for an integrated circuit chip (IC chip) incorporated in the system. Specifically, as stated above, an electrical connector may be designed to coupled data transmission lines or conductors to a printed circuit board. Conventional circuit traces on the board interconnect with the IC chip. A programmable bus or strip may be provided to program the IC chip to whatever electronic configuration is in the machine or other device. In essence, the programmable strip tells the IC chip to perform various electronic functions by selectively shorting out circuit traces on the printed circuit board. In this manner, a generic IC chip can be provided and simply programmed within the assembly.

Heretofore, such programmable buses or strips most often have included individual spring contacts which are selectively bent downward, or broken away, so that they do not engage particular circuit traces on the printed circuit board and, thereby, selectively short out the circuit traces. Bending the spring contacts to shorting positions often has not proven effective. Breaking away selective spring contacts often leave undesirable edges, require tedious manipulations and, like the bending operations, permanently alter or deform the programming strip configuration.

This invention is directed to providing an improved programming strip in electronic systems of the character described, wherein the spring contacts are positively held in inoperative or shorting positions.

SUMMARY OF THE INVENTION

An object, therefore, of the invention is to provide a new and improved programmable input-output electrical connector of the character described.

In the exemplary embodiment of the invention, a programmable input-output electrical connector is illustrated as adapted for electrically coupling a plurality of conductors with an electronic component having a plurality of circuits. The connector includes a dielectric housing, and a programming multi-contact bus is mounted in the housing. The bus has a plurality of spring contacts biased into engagement with respective circuits on the electronic component. The spring contacts are individually selectively movable to inoperative positions out of engagement with the circuits on the electronic component. Generally, the invention contemplates the provision of latch means operatively associated with the spring contacts for positively holding each spring contact individually in its inoperative position.

In one embodiment of the invention, generally, the latch means include a complementary interengaging latch device between each spring contact and the connector housing. Specifically, the dielectric housing is fabricated of plastic material, and each latch device includes at least one barb on the respective spring contact for skiving into the housing into latched engagement therewith.

In another embodiment of the invention, generally, the latch means include a complementary interengaging latch device between each spring contact and the bus. The spring contact is in the form of a cantilevered arm, and the latch device includes a latch shoulder on the bus behind which the cantilevered arm can be selectively snap-latched.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
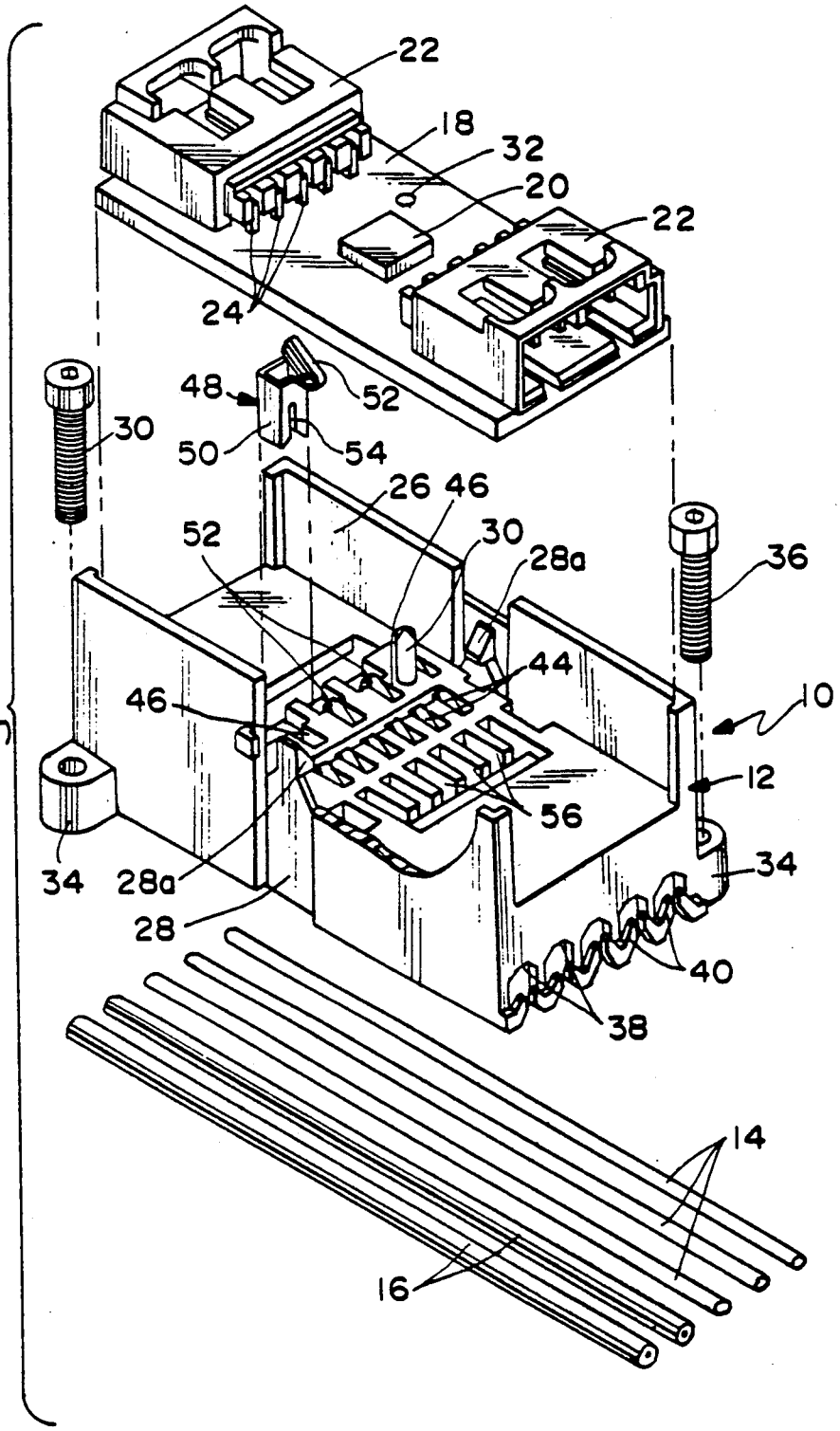
FIG.1 (PRIOR ART)
FIG. 1 is an exploded perspective view, of an electrical connector assembly for terminating a plurality of discrete insulated conductor wires, according to the prior art.

Referring to the drawings in greater detail, and first to FIG. 1, an electrical connector assembly, generally designated 10, is shown to include a common housing, generally designated 12. Connector assembly 10 is in accordance with the prior art as shown in U.S. Pat. No.

5,125,846 to Sampson et al, dated Jun. 30, 1992, which is assigned to the assignee of the present invention and which is incorporated herein by reference. The electrical connector assembly is an input-output connector for coupling a plurality of conductors of different configurations with an electronic component. As illustrated in FIG. 1, the conductors are conventional discrete insulated conductor wires, including three data transmission wires 14 and two power transmission wires 16. The electronic component is shown in the form of a conventional printed circuit board 18 having circuit traces thereon. An integrated circuit chip 20 is mounted on top of the printed circuit board, and a pair of header connectors 22, having terminal pins 24, are mounted on top of the printed circuit board. The housing mounts terminals for coupling data and power transmission lines 14 and 16, respectively, to the circuit traces on printed circuit board 18.

The connector assembly described above can be used for distributing power and data through a copying machine, for instance. Control electronics from a control station run through the machine in data and power transmission lines 14 and 16, respectively. The connector terminates the lines to circuit traces on printed circuit board 18, and IC chip 20 distributes the power and data to various devices in the machine through header connectors 22 which receive complementary connectors (not shown) electrically coupled to the various devices such as motors, audible and visual indicating means, and the like. For instance, the control electronics may include an actuator to change the degree of reduction of the copying machine from an original copy sheet. The IC chip will tell a motor on the machine its respective function, through one of the header connectors 22, through a complementary connector leading to the particular motor.

Figure 2:
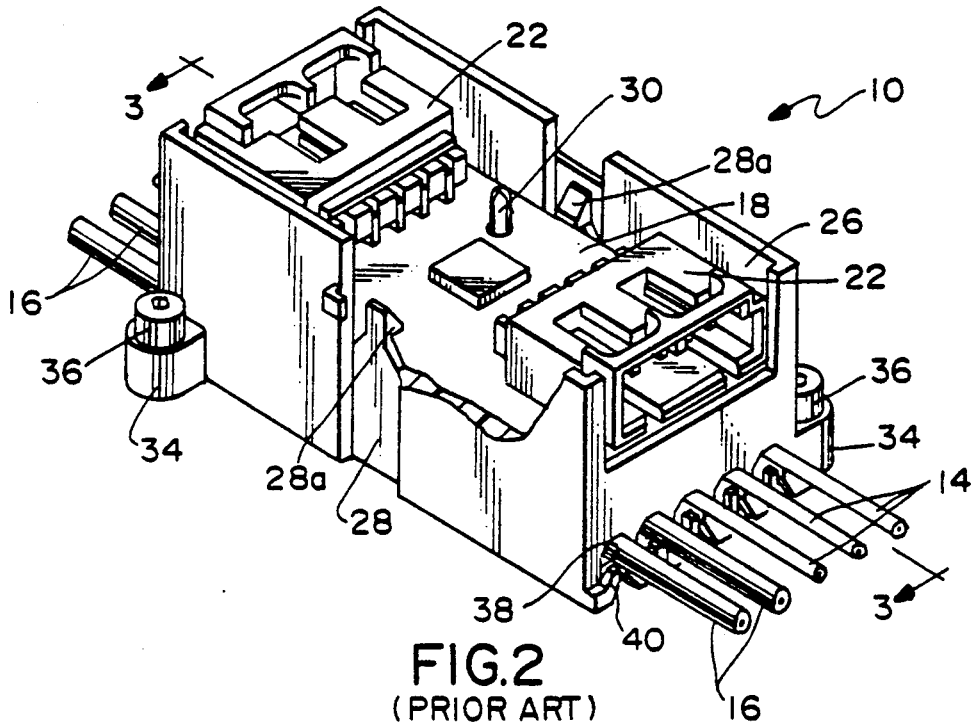
FIG.2 (PRIOR ART)
FIG. 2 is a perspective view of the electrical connector assembly of FIG. 1 in assembled condition terminating the insulated conductor wires.

More specifically, common housing 12 is recessed in the top thereof to define a pocket 26 for receiving printed circuit board 18. The printed circuit board is shown in FIG. 2 disposed within the pocket. The housing is integrally molded of plastic material, such as glass filled polyester, and includes a pair of integrally molded latch arms 28 having hook portions **28*a* whereby the hook portions snap over the top of printed circuit board 18 when fully seated in the housing as shown in FIG. 2. The housing may have an upwardly protruding polarizing pin 30 for insertion through a polarizing hole 32 in the printed circuit board. The housing also has a pair of outwardly protruding bosses 34 through which a pair of screws or bolts 36** can be inserted to securely mount the housing to a frame of the machine (not shown).

Integrally molded housing 12 has locating means in the form of a plurality of channels 38 for locating discrete insulated conductor wires 14 and 16. The channels are partially closed by retention fingers 40 whereby the conductors or wires are retained in the channels by snapping the conductors past the retention fingers.

Figure 3:
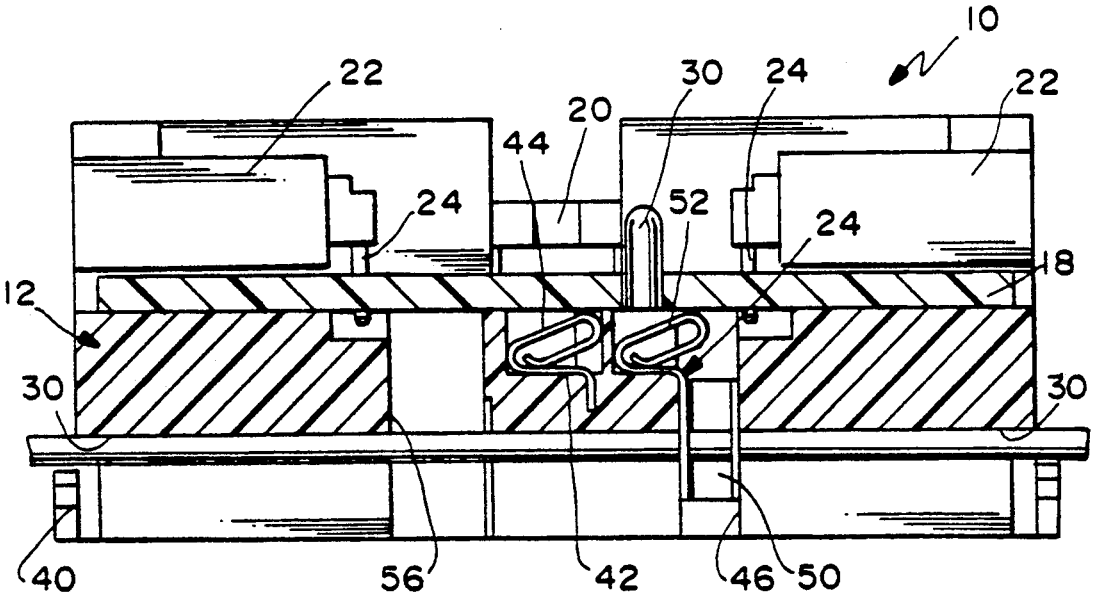
FIG.3 (PRIOR ART)
FIG. 3 is a vertical section taken generally along line 3—3 of FIG. 2.

Referring to FIG. 3 in conjunction with FIG. 1, in the particular application of electrical assembly 10 described herein, a programming strip 42 is mounted in housing 12, with a plurality of upwardly projecting, cantilevered contact portions 44. As stated above, the electrical connector is designed to couple data transmission lines or conductors 14 to printed circuit board 18. Conventional circuit traces on the printed circuit board interconnect with IC chip 20. Programming strip 42,44 is provided to program the IC chip to whatever electronic configuration is in the machine. The strip is programmed by selectively bending one or more of cantilevered contact portions 14 downwardly so that they do not engage particular circuit traces on the underside of the printed circuit board. In essence, the programming strip tells the IC chip to perform various electronic functions by selectively shorting out circuit traces on the printed circuit board. In this manner, a generic IC chip can be provided and simply programmed within the assembly.

Still referring to FIG. 3 in conjunction with FIG. 1, common housing 12 includes a plurality of first receptacle means in the form of through passages 46 for receiving a plurality of wire insulation displacement terminals, generally designated 48, which are press-fit into the passages. In the embodiment illustrated, five passages 46 are provided for five terminals 48 corresponding to the five data and power transmission conductors or lines 14 and 16, respectively. Of course, it should be understood that this number is for illustration purposes only.

Each wire insulation displacement terminal 48 includes a wire insulation displacement portion 50 and a surface mounting or engagement portion 52. The wire insulation displacement portion 50 includes a slot 54 for piercing the insulation about a respective one of the discrete conductors to establish conductivity with the conductor wire therewithin, as seen in FIG. 3. Surface mounting portion 52 projects upwardly for engagement with an appropriate circuit trace on printed circuit board 18, also as shown in FIG. 3.

As stated above, the prior art includes programming strip 42,44 to program IC chip 20 to whatever electronic configuration is in the machine. The present invention is directed to a new system for providing a programming strip or bus in which individual spring contact portions of the bus are positively latched in their inoperative or shorting positions. Generally, one embodiment of the invention is shown in FIGS. 4 and 5, and another embodiment of the invention is shown in FIGS. 6 and 7.

Figure 4:
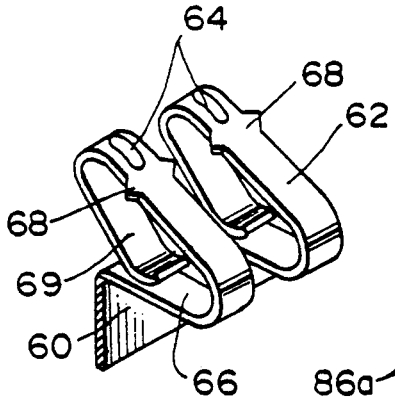
FIG. 4 is a fragmented perspective view of a section of a programming bus, incorporating a plurality of spring contacts according to the invention.

More particularly, FIG. 4 shows a section of a programming strip 60 along which are spaced a plurality (only two shown in FIG. 4) of spring contacts 62 having contact bosses 64. The contact bosses may be plated and provide positive contact points for engaging circuit traces on printed circuit board 18. Spring contacts 62 extend between a base portion 66 projecting horizontally from programming strip or bus 60, and a reverse bent portion 69 which engages the base to provide biasing reinforcement for the spring contact.

Generally, latch means are operatively associated with spring contacts 62 for positively holding each spring contact individually in its inoperative or shorting position. Specifically, as stated above, housing 12 is integrally molded of plastic material. Each spring contact 16 includes a pair of pointed barbs 68 projecting outwardly from opposite sides thereof. As shown in FIG. 5, the barbs project into grooves 70 in the side walls of cavities 72 in housing 12 which receive the spring contacts. The barbs are dimensioned for skiving into the housing within the grooves to hold the spring contacts in respective inoperative or shorting positions. Therefore, as seen in FIG. 5, the spring contact portion therein has been biased downwardly in the direction of arrow "X", whereupon barbs 68 skive into the plastic housing, within grooves 70, and hold contact bosses 64 below the upper surface of housing 12 or at least below a point of engagement with the circuit traces on printed circuit board 18.

Figure 6:
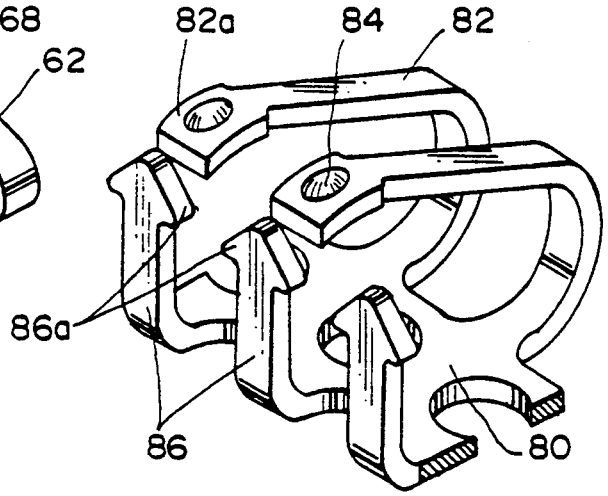
FIG. 6 is a perspective view of an alternate form of programming bus incorporating the concepts of the invention.
Figure 5:
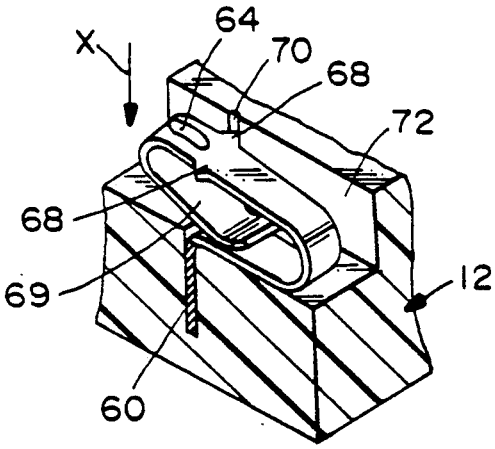
FIG. 5 is a fragmented perspective view of one of the spring contacts of FIG. 1, in its respective cavity in the housing, and in its inoperative position.
Figure 7:
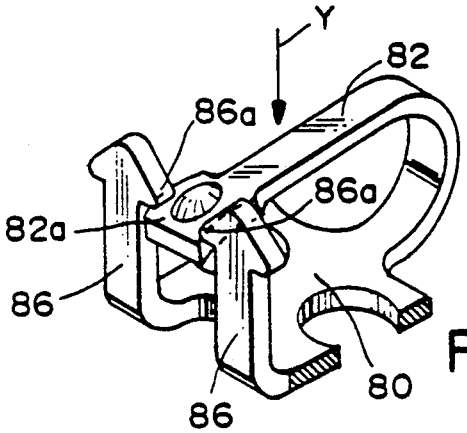
FIG. 7 is a view similar to that of FIG. 6, with one of the spring contacts in its inoperative position.

FIGS. 6 and 7 show an alternate embodiment of the invention wherein, like the embodiment of FIGS. 4 and 5, latch means are operatively associated with the spring contacts of a programming strip or bus for positively holding each spring contact individually in its inoperative or shorting position. More particularly, FIG. 6 shows a strip or bus 80 having a plurality (only two shown in the drawing) of spring contacts 82 formed by cantilevered arms projecting upwardly and over the top of the programming strip. Each spring contact includes a contact boss 84 at its distal end 82*a*. Again, the contact bosses may be plated and provide positive contact points for engaging the circuit traces on printed circuit board 18. A pair of latch arms 86 project upwardly from strip 80 on opposite sides of each spring contact 82 and in registry with distal ends 82*a*. The latch arms have latch hooks 86*a* which have angled camming surfaces at the tops thereof and latching shoulders at the bottoms thereof. The latch hooks project into the path of distal ends 82*a* of spring contacts 82.

Therefore, and referring to FIG. 7, when one of the spring contacts 82 is pushed downwardly or inwardly in the direction of arrow "Y", distal end 82*a* of the spring contact engages the angled tops of latch hooks 86*a* of latch arms 86 and spread the latch arms such that the latch hooks will snap back into latching positions as shown in FIG. 7 to hold the respective spring contact 82 in its depressed, inoperative or shorting position.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In a programmable input-output electrical connector for electrically coupling a plurality of conductors with an electronic component having a plurality of circuits, the connector including a dielectric housing and a programming multi-contact bus mounted in the housing, the bus having a plurality of spring contacts normally biased into engagement with respective circuits on the electronic component, the spring contacts being individually selectively movable to inoperative positions out of engagement with the circuits, wherein the improvement comprises latch means operatively associated with the spring contacts for positively holding each spring contact individually in its inoperative position, and wherein said latch means comprise a complementary interengaging latch device between each spring contact and the connector housing.

2. In a programmable input-output electrical connector as set forth in claim 1, wherein said dielectric housing is fabricated of plastic material, and each latch device includes at least one barb on the respective spring contact for skiving into the housing into latched engagement therewith.

3. A programmable input-output electrical connector for electrically coupling a plurality of conductors with an electronic component having a plurality of circuits, comprising:

a dielectric housing of plastic or like material; and a programming multi-contact bus mounted in the housing and including a plurality of spring contacts normally biased into engagement with respective circuits on the electronic component, each spring contact being individually selectively movable to an inoperative position out of engagement with its respective circuit, and each spring contact including at least one barb for skiving into the housing into latched engagement therewith to positively hold the spring contact in its inoperative position.

* * * * *